United States Patent [19]

Savell

[11] 4,455,899

[45] Jun. 26, 1984

[54] IMPACT WRENCH

[76] Inventor: Harvey E. Savell, Rte. 1, Box 130, Little Rock, Miss. 39337

[21] Appl. No.: 381,043

[22] Filed: May 24, 1982

[51] Int. Cl.[3] ..... B25B 19/00

[52] U.S. Cl. ..... 81/466

[58] Field of Search ..... 81/465, 466

[56] References Cited

U.S. PATENT DOCUMENTS

| | | | |
|---|---|---|---|
| 1,787,185 | 12/1930 | Baird | 81/466 |
| 3,157,074 | 11/1964 | Durkee | 81/466 |
| 3,158,050 | 11/1964 | Shandel | 81/466 |
| 3,831,468 | 8/1974 | Miller | 81/466 |

*Primary Examiner*—James L. Jones, Jr.

*Attorney, Agent, or Firm*—John M. Harrison

[57] ABSTRACT

An impact wrench for removing and tightening nuts, including wheel lug nuts, which includes a lug bar or shaft provided with a shaped drive at one end to receive a socket of appropriate size, an impact frame rotatably mounted on the lug bar by means of a collar and pinned inside a handling ring for manipulating the impact wrench, and an impact arm secured to the lug bar at a point intermediate the ends of the collar and in the rotational path of a pair of impact bars attached to the impact frame to facilitate impact between the impact bars and the impact arm responsive to rotational force applied to the ring.

8 Claims, 7 Drawing Figures

IMPACT WRENCH

BACKGOUND OF THE INVENTION

1. Field of the Invention

This invention relates to a tool for removing and tightening wheel lug nuts on automobiles and conventional bolts, and more particularly, to an impact wrench which is mechanical in function and requires no hydraulic or pneumatic power for operation. The impact wrench of this invention is characterized by a round lug bar having a shaped drive at one end for receiving conventional sockets of various size, and an impact frame rotatably mounted on the lug bar and designed to strike an impact arm secured to the lug bar in order to provide the desired impact for tightening and loosening the nuts. The impact frame further includes supporting struts, each having one end attached to a collar or collar segments which are rotatably mounted on the lug bar, and the opposite end pivotally secured to a ring which is used to handle and manipulate the impact wrench. Sockets of various size which are compatible with the nuts to be removed or tightened can be easily mounted and removed from the lug bar drive.

2. Description of the Prior Art

Tools for tightening and loosening nuts or bolts of various description have been used for many years. Typical of such tools is the wrench disclosed in U.S. Pat. No. 226,149, to J. H. Alexander, which tool represents an early design incorporating a wheel or ring on a lug bar or shaft having a socket secured to one end. The wheel is designed for grasping and exerting maximum force on the lug shaft to loosen and tighten the nuts. A later wrench having a wrench handle which is pivotally mounted on an L-shaped lug bar, is disclosed in U.S. Pat. No. 1,597,747, to F. Wermes, and is designed to use sockets of various size. A similar "Socket Wrench Tool" is disclosed in U.S. Pat. No. 1,744,413, to E. H. Peterson, et al, which tool is provided with a handle having separable parts which can be combined to selectively form a T-shaped or an L-shaped handle. A "Folding Tire Wrench" for removing lug nuts from automobile wheel studs is disclosed in U.S. Pat. No. Des. 178,035. The lug-engaging socket elements of the tire wrench are mounted on opposite ends of a pair of shaped lug bars which are pivotally connected in the center to facilitate folding for easy storage.

One of the problems associated with conventional wrenches which are designed to remove nuts from bolts, and particularly, with lug wrenches built to loosen lug nuts from wheel studs, is the difficulty of bringing sufficient leverage to bear on the wrench to "break" the nut loose. Another problem which is frequently encountered is the provision of only a single, or in the case of the conventional X-shaped lug wrenches, only four socket sizes, since most of the conventional lug wrenches are built to remove and secure wheel lug nuts of a specific size, and may not fit the lug nuts of a vehicle for which they were not specifically designed. This problem is particularly well recognized when changing the tires of foreign cars, which may use lug nuts having metric dimensions.

Accordingly, it is an object of this invention to provide a tool for selectively loosening and tightening nuts on bolts, which includes a lug bar having a socket drive at one end and an impact frame rotatably mounted intermediate the ends of the lug bar, and a carrying member attached to the opposite ends of the impact frame for carrying and handling the tool, and further including an impact arm secured to the lug bar and positioned for impact by the impact frame upon rotation of the carrying member and the impact frame in order to loosen or tighten a nut engaged by a socket mounted on the lug bar drive.

Another object of this invention is to provide an impact wrench which is characterized by a round lug bar having a drive at one end for engaging sockets, an impact frame fitted with a pair of collar segments which are rotatably mounted on the lug bar and pivotally attached to a handling ring which circumscribes the impact frame, and an impact arm secured to the lug bar at a point between the collar segments to facilitate rotation of the ring in the appropriate direction and impacting the impact frame on the projecting ends of the impact arm to loosen or tighten a nut which is engaged by a socket fitted to the lug bar drive.

Yet another object of the invention is to provide an impact wrench for mechanically loosening and tightening lug nuts and other threadably-mounted nuts and fasteners, which impact wrench includes a straight lug bar having a shaped drive secured to one end for receiving sockets of various size, an impact frame secured to a pair of collar segments which are rotatably mounted in spaced relationship on the lug bar, the impact frame further characterized by frame struts, each having one end attached to one of the collar segments and the opposite end pivotally pinned to a ring which circumscribes the impact frame and is foldable on the frame when not in use and can be pivoted to a functional position for operation of the impact wrench, and further including an impact arm secured to the lug bar at a point between the collar segments for rotatable engagement by the impact frame when a socket is positioned on the lug bar drive and is placed in engagement with a nut to be tightened or loosened, and the ring is forcefully rotated in the appropriate direction.

SUMMARY OF THE INVENTION

These and other objects of the invention are provided in an impact wrench for removing and tightening nuts or bolts, and particularly, lug nuts on wheel studs, which impact wrench includes a straight, round lug bar fitted with a shaped drive at one end, an impact frame symmetrically mounted on a pair of collar segments which are in turn rotatably mounted on the lug bar, a ring pivotally secured to the ends of the impact frame extending from the collar segments and circumscribing the impact frame, and at least one impact arm projecting from the lug bar at a point between the collar segments to facilitate impacting certain structural components of the impact frame with the impact arm by rotation of the ring to loosen or tighten a nut engaged by a socket fitted to the lug bar drive.

BRIEF DESCRIPTION OF THE DRAWING

The invention will be better understood by reference to the accompanying drawing, wherein.

DESCRIPTION OF THE PREFERRED EMBODIMENTS

Figure 1:
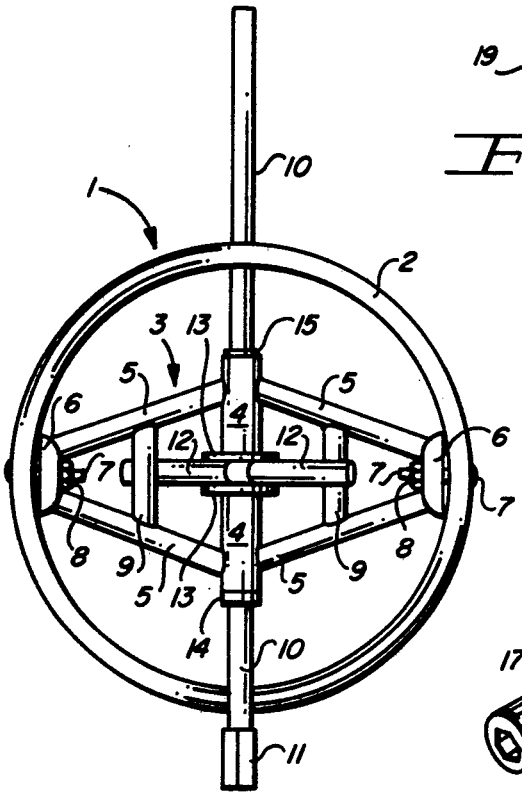
FIG. 1 is a top elevation of the impact wrench of this invention in folded configuration.

Referring to FIG. 1 of the drawing, the impact wrench of this invention is generally illustrated by reference numeral 1, and includes a lug bar 10, having a lug bar drive 11 shaped at one projecting end, as a principal element. In a preferred embodiment of the invention the lug bar 10 is round and the cross-section of the lug bar drive 11 is shaped in the form of a square of selected size to accommodate a socket of appropriate size. An impact frame, generally illustrated by reference numeral 3, includes a pair of spaced collar segments 4, which are journalled for rotation on lug bar 10. In a preferred embodiment of the invention collar segments 4 are maintained in rotatable configuration on the lug bar 10 by means of a lug bar flange 14, on lug bar 10 and positioned adjacent one of the collar segments 4, and a removable retainer ring 15, which is snapped into position in a cooperating groove (not illustrated) in lug bar 10 adjacent the other one of collar segments 4. A pair of struts 5 extend from fixed attachment to each side of the collar segments 4 in 180 degree, opposed relationship, and each pair of the struts 5 terminate in converging attachment to a pivot base 6, respectively, located on opposite sides of the impact frame. One of a pair of impact bars 9 joins each extending pair of struts 5 between the points of attachment of the struts 5 to the collar segments 4 and to each pivot base 6. A ring 2 circumscribes the impact frame 3 and is attached to each pivot base 6 by means of a pivot bolt 7 and a cooperating nut 8. In a preferred embodiment of the invention the ring 2 is pivotally attached to the pivot base 6, and the outside edge of pivot base 6 which is adjacent a portion of the inside surface of the ring 2 is shaped to slidably engage this portion of the inside surface of ring 2, in order to facilitate easy folding of the ring 2 against the lug bar 10 for storage of the impact wrench 1, as illustrated. An impact arm 12 is fixedly secured to the lug bar 10 between the collar segments 4, and in a preferred embodiment, the impact arm 12 extends outwardly from both sides of the lug bar 10 in 180 degree, oppositely disposed relationship. It will be appreciated by those skilled in the arm that a single impact arm 12 segment can be extended from one side of the lug bar 10, although an impact arm 12 which projects in oppositely disposed relationship from the lug bar 10 is most preferred in the impact wrench 1, for optimum operation of the impact wrench 1. The impact arm 12 extends outwardly of the lug bar 10 beyond the impact bars 9, respectively, in order that the free rotation of the impact frame on lug bar 10 in a 360 degree movement is prevented by contact between the impact bars 9 and the impact arm 12. Spacers 13 serve to help facilitate smooth rotation of the collar segments 4 on the lug bar 10.

Figure 6:
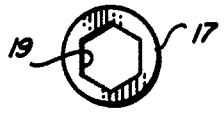
FIG. 6 is a bottom end elevation of a conventional socket for use with the impact wrench of this invention.
Figure 7:
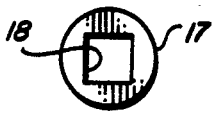
FIG. 7 is a top end view of the conventional socket illustrated in FIG. 6.
Figure 2:
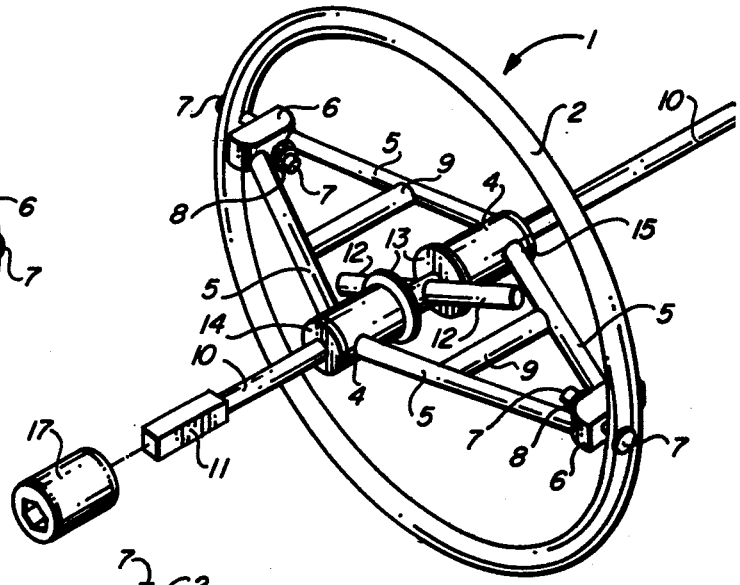
FIG. 2 is a perspective view of the impact wrench in functional configuration.
Figure 3:
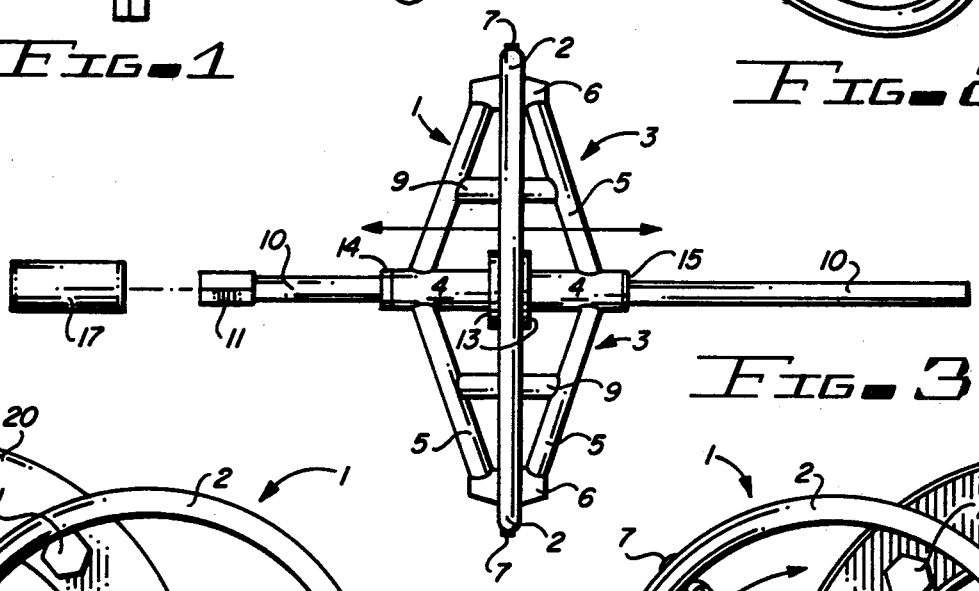
FIG. 3 is a side elevation of the impact wrench illustrated in FIGURE 2.
Figure 4:
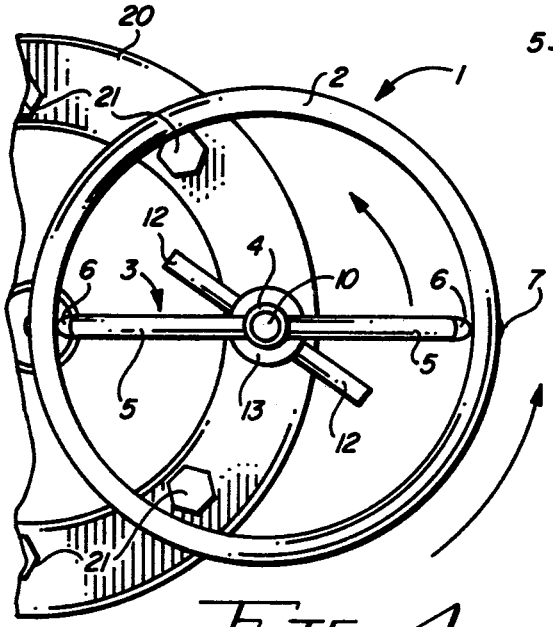
FIG. 4 is an end elevation of the impact wrench with a socket in position on the wrench and engaging the lug nut of a vehicle wheel and the wrench positioned for manipulation to remove the lug nut.

Referring now to FIGS. 2, 3, 6 and 7 of the drawing, when the ring 2 is pivoted on pivot bolt 7 from the folded position illustrated in FIG. 1 to the functional, open configuration shown in FIGS. 2 and 3, then ring 2 is positioned in a plane which is approximately perpendicular to the plane of the impact frame 3. A conventional socket 17 of selected nut aperture 19 size and having a drive aperture 18 of sufficient size to register with the lug bar drive 11 on a projecting end of lug bar 10, is illustrated in FIGS. 3, 6 and 7, and can be removably positioned on lug bar drive 11, as illustrated in FIG. 3. It will be furthe appreciated that the lug bar drive 11 can be of any desired size, such as a ½ inch or a ⅜ inch drive, as desired, and a socket 17 having a compatible drive aperture 18 and a selected nut aperture 19 can be chosen to mount on lug bar drive 11, to remove or tighten a nut of substantially any size.

In operation, and referring now to FIGS. 1–4, 6 and 7 of the drawing, by way of example, when it is desired to remove one of the wheel lugs 21 from a cooperating stud in the wheel rim 20 of a vehicle using the impact wrench 1 of this invention, socket 17 having a nut aperture 19 corresponding to the size of the wheel lugs 21, and a drive aperture 18 which will fit the lug bar drive 11 of lug bar 10, is first chosen. The socket 17 is then fitted on the end of lug bar 10 by registering the lug bar drive 11 with the drive aperture 18. The ring 2 of impact wrench 1 is then rotated on pivot bolts 7 from the stored configuration illustrated in FIG. 1 to the functional configuration shown in FIGS. 2–4, and the impact wrench 1 is moved into the position illustrated in FIG. 4 with the nut aperture 19 fitted over one of the wheel lugs 21. When the impact wrench 1 is in this functional configuration the lug bar 10 and impact arm 12 are immobilized on the wheel lug 21, and the ring 2 and impact frame 3 can be rotated from first points of contact between the impact bars 9 and the impact arm 12, through an arc of approximately 180 degrees to second points of contact between the same members. Accordingly,referring again to FIG. 4, a considerable force can be applied to the impact arm 12, the lug bar 10 and the engaged one of wheel lugs 21, by initially rotating the ring 2 in the clockwise direction to a position of first contact between the impact bars 9 and the impact arm 12, and subsequently thrusting the ring 2 in a conterclockwise direction as indicated by the arrow, to a position of second contact or impact between the impact bars 9 and the impact arm 12. This procedure is repeated until the wheel lug 21 is loosened. The force of impact between the impact bars 9 and the impact arm 12 at the position of second contact in a repetitive fashion has proved highly effective in loosening the wheel lugs 21 one by one.

Figure 5:
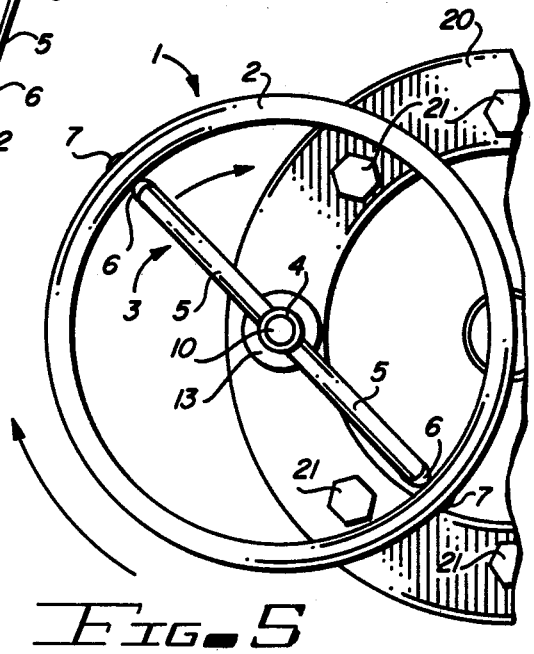
FIG. 5 is an end elevation of the impact wrench illustrated in FIG. 4, with the wrench positioned for manipulation to tighten the lug nut.

Referring to FIG. 5, when it is desired to tighten the wheel lugs 21 on the respective studs mounted in the wheel rim 20 using the impact wrench 1, the wheel lugs 21 are first hand-tightened on the studs in conventional fashion. The socket 17 is then again fitted over the wheel lugs 21, and one by one, the wheel lugs 21 are tightened by operating the impact wrench 1 in the clockwise direction as indicated by the arrow, according to the reverse of the procedure outlined above for loosening the wheel lugs 21 but with less force, according to the degree of tightness desired.

It will be appreciated by those skilled in the art that the impact wrench 1 can be manufactured of substantially any sturdy material having good strength characteristics, and in a preferred embodiment, the impact wrench 1 is built of iron or steel. Furthermore, the respective component parts of impact wrench 1, such as the components of the impact frame 3, in non-exclusive particular, can be cast, or the components can be attached by welding or by other techniques known to those skilled in the art. Furthermore, the diameter of ring 2 and the length of the impact frame 3, as well as the weight of the impact wrench 1 can be varied according to the size of the wheel lugs 21 or other nuts or bolts to be removed, tightened or loosened. Since the impact or force applied to the socket 17, and hence, the nut to be loosened or tightened, is a function of the combined weight of the ring 2 and impact frame 3, the radius of the ring 2 and the force applied to the ring 2, the impact wrench 1 of this invention can be designed for substantially any desired application.

Referring again to FIGS. 1–3 of the drawing, it will be appreciated by those skilled in the art that the collar segments 4 can be journalled for rotation on the lug bar 10 in substantially any desired manner, including the use of bearings or bushings, or by direct contact between the segment aperture and the lug bar 10, depending upon the application desired. Furthermore, in a most preferred embodiment of the invention the lug bar flange 14 is either formed integrally with the lug bar 10, or is otherwise permanently attached, and the collar segments 4 are solid and bored or cast to receive the end of the lug bar 10 opposite the lug bar drive 11. When the end of lug bar 10 opposite lug bar drive 11 is inserted through the collar segments 4 to the point of coincidence of the lug bar flange 14 and one of the collar segments 4, the retainer ring 15 is snapped into a groove in lug bar 10 adjacent the other one of collar segments 4, and the lug bar 10 is rotatably secured in both of the collar segments 4. Alternatively, the collar segments 4 can each be formed in two segments which can be bolted onto cooperating polished or smooth segments of the lug bar 10, and a pair of retainer rings can be used to keep the lug bar 10 in position inside the collar segments 4. Other variations in mounting the collar segments 4 on the lug bar 10 will be apparent to those skilled in the art without departing from the spirit and scope of the invention.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An impact wrench for loosening and tightening nuts, comprising a lug bar and a drive means on one end of said lug bar; a first collar segment and a second collar segment journalled for rotation on said lug bar in spaced relationship; a first pair of struts having one end rigidly attached to said first collar segment and the opposite end extending outwardly from said first collar segment in oppositely-disposed relationship; a second pair of struts having one end rigidly attached to said second collar segment and the opposite end extending outwardly from said second collar segment in oppositely-disposed relationship; first impact bar means connecting the ones of said struts which extend in a first direction from said first collar segment and said second collar segment, respectively; second impact bar means connecting the ones of said struts which extend in a second direction from said first collar segment and said second collar segment, respectively; and a pivot base means attached to said opposite end of each of said struts extending in said first direction and said second direction, respectively; handling means attached to said pivot base means and an impact arm rigidly attached to said lug bar and extending outwardly from said lug bar and into the rotational path of said first and second impact bar means whereby rotation of said handling means causes said first and second impact bar means to contact said impact arm and apply a torque to said lug bar.

2. The impact wrench of claim 1 wherein said drive means is a square socket drive for removable registration with the drive aperture of a socket.

3. The impact wrench of claim 1 wherein said handling means is a ring pivotally attached to said impact means and circumscribing said impact means.

4. The impact wrench of claim 1 wherein:

(a) said handling means is a ring pivotally attached to said pivot base and circumscribing said impact means; and (b) said drive means is a square socket drive for removable registration with the drive aperture of a socket.

5. The impact wrench of claim 1 wherein said impact arm extends outwardly from said lug bar in oppositely disposed relationship.

6. The impact wrench of claim 1 wherein:

(a) said handling means is a ring pivotally attached to said impact means and circumscribing said impact means;

(b) said impact arm extends outwardly from said lug bar between said collar segments in oppositely-disposed relationhip and into the rotational path of said impact bar; and (c) said drive means is a square socket drive for removable registration with the drive aperture of a socket.

7. An impact wrench for loosening tightening nuts comprising:

(a) a lug bar and a drive means shaped on one end of said lug bar for receiving a socket;

(b) a pair of collar segments rotatably carried by said lug bar in spaced relationship; a first pair of struts having one end rigidly attached to said collar segments, respectively, and the opposite end extending outwardly of said collar segments; a second pair of struts having one end rigidly attached to said collar segments, respectively, and the opposite end extending outwardly of said collar segments in oppositely-disposed relationship with respect to said first pair of struts; a first impact bar connecting said first pair of struts and a second impact bar connecting said second pair of struts; a pivot base attached to each of said opposite end of said first pair of struts and said second pair of struts, respectively; a handling ring circumscribing said first pair of struts and said second pair of struts adjacent said pivot base; and pivot means joining said pivot base and said handling ring whereby said handling ring pivots on said pivot base into a selective folding and functional configuration; and (c) an impact arm rigidly attached to said lug bar and extending outwardly in oppositely-disposed relationship from said lug bar into the rotational path of said first impact bar and said second impact bar, whereby impact between said first impact bar and said second impact bar and said impact arm responsive to force applied to said handling ring causes a torque to be applied to said lug bar and said socket to loosen a nut engaged by the socket.

8. The impact wrench of claim 7 wherein said driven is a square socket drive for removable registration with the driven aperture of a socket, and said pivot pin means is a pivot bolt and a cooperating pivot nut.

* * * * *